United States Patent [19]

Curry

[11] 4,367,468

[45] Jan. 4, 1983

[54] D.C. INPUT SHIFT PANEL DRIVER CIRCUITS-BIASED INPUTS

[75] Inventor: John L. Curry, Colorado Springs, Colo.

[73] Assignee: NCR Corporation, Dayton, Ohio

[21] Appl. No.: 219,044

[22] Filed: Dec. 22, 1980

[51] Int. Cl.[3] ..... G09G 3/28

[52] U.S. Cl. ..... 340/768; 315/169.2; 315/169.4

[58] Field of Search ..... 340/768, 769; 315/169.2, 169.4

[56] References Cited

U.S. PATENT DOCUMENTS

| | | | |
|---|---|---|---|
| 3,781,600 | 12/1973 | Coleman et al. | 340/800 X |
| 3,976,993 | 8/1976 | Hirose et al. | 340/768 |
| 4,051,409 | 9/1977 | Craycraft | 340/768 X |

*Primary Examiner*—David L. Trafton

*Attorney, Agent, or Firm*—J. T. Cavender; Philip A. Dalton; Casimer K. Salys

[57] ABSTRACT

An electronic circuit for energizing a plasma charge transfer type display system, utilizing a display panel having input driver circuits for selectively creating trapped charge in designated lines of the display panel and phase driver circuits for sequentially shifting that charge into prescribed display panel locations. A synchronized switching voltage supply provides abruptly alternating negative and positive voltage levels to the group of input driver circuits. The separate group of phase driver circuits is supplied with a fixed level of positive polarity voltage. Selective synchronization of the input and the phase driver circuit output voltages by way of the control logic creates large transitions of relative voltage between designated input and phase electrodes within the display panel. The large but transient voltage between the selected electrodes causes the gas within the associated display panel cells to ionize and form trapped charge adjacent the selected line phase electrodes. Thereafter, the charge is moved in conventional manner by successive pulses to the phase electrodes. In the alternative, if the synchronized command signals to the phase driver circuits result in a zero voltage level at the phase electrodes during that period, the large transitions of relative voltage are absent and no charge is trapped for subsequent transfer into the display panel. The use of a dual polarity voltage source and conductive paths in the input driver circuits lowers the nominal operating voltages of the driver circuit electronic elements. Consequently, hybrid or monolithic devices can be utilized in locations heretofore restricted to discrete high voltage electronic components.

8 Claims, 5 Drawing Figures

INPUT DRIVER

D.C. INPUT SHIFT PANEL DRIVER CIRCUITS-BIASED INPUTS

CROSS-REFERENCE TO RELATED APPLICATIONS

This invention is related to co-pending patent application Ser. No. 177,329, filed Aug. 12, 1980, to inventors Skaggs and Curry. Inventor Curry and the assignee are common to both applications.

BRIEF SUMMARY

The present invention is directed to a circuit for energizing a plasma charge transfer display system of the type having a multiplicity of input driver circuits, individually connected through input lines to loading electrodes within the display panel, and a group of phase driver circuits, connected through phase lines to a prescribed pattern of other electrodes within the display panel. Charge is created by ionizing the cell gas between selected input electrodes and the first of the phase electrodes, and is shifted in a controlled manner to designated locations within the display panel by selectively energizing the succession of phase electrodes. The charge creation and transfer functions are regulated by a control logic block, which defines the sequence for energizing the input and phase driver circuits in order to create, shift and hold luminous patterns within the display. The input driver circuits are supplied with power from a switched voltage supply which alternates abruptly and sequentially between fixed positive and negative polarity voltage sources. Switching is synchronized by the control logic.

In one form, the amplitude of the positive polarity voltage source is selected so that it is substantially equal to the voltage required to transfer trapped charge between successive phase electrodes. In such a case, the amplitude of the negative polarity voltage is constrained by the requirement that there be sufficient transient voltage to cause cell gas ionization between selected input electrodes and their adjacent phase electrodes when one is abruptly connected to the positive polarity voltage source as the other is connected to the negative polarity voltage source. The two sources of voltage conduct power to the multiplicity of input driver circuits through a switching means which provides at its output either one or the other of the voltages, in a repetitive, rapidly transitioning sequence. The phase driver circuits are energized through a direct connection to one of the voltage sources.

The control logic block generates command signals which are directed to the multiplicity of input driver and phase driver circuits. The phase driver circuits are sequentially energized to provide the display phase electrodes with pulses having an upper level equal to the positive polarity voltage and a lower level of substantially zero voltage. The input driver circuits, however, are supplied with power from a switching voltage alternating abruptly and periodically between positive and negative voltage levels. Whenever the switched voltage is negative in polarity, a nonlinear conductive path applies it directly to all the input lines. During the positive polarity segment of the switched voltage, the input lines receive the positive polarity voltage pulses, but only when the corresponding input drivers are energized by command signals from the control logic. Absent such command signals the associated input lines remain at substantially zero voltage during the positive segment.

The control logic synchronizes the timing of the switching means, the input driver command signals and phase driver command signals to ensure that the electrode voltage levels, polarities and transition rates are appropriate for the formation of trapped wall charge and its transfer through the display panel. In addition, the control logic, according to the teaching in the prior art, selectively energizes the input driver circuits at each timing interval to create prescribed patterns within the display panel. In the context of the embodiment, the control logic energizes the input and phase driver circuits so that input electrodes prescribed to load charges into the display are connected to the negative polarity voltage through the switching means when the first of the phase electrodes is energized with the positive polarity voltage. Thereafter, the selected input electrodes are rapidly driven to the positive voltage level by the switching means as the first phase electrode is brought abruptly to substantially zero voltage, causing the cell gas to ionize and thereby create a wall charge on the first of the phase electrodes. At the onset of the second phase, control logic command signals energize the first phase driver circuit to provide positive polarity voltage to the first phase electrode at the same time that the second phase electrode driver circuit output is commanded from its normal positive voltage level to a substantially zero voltage. Accordingly, trapped charge adjacent the first phase electrode is transferred to a location adjacent the second phase electrode. The succeeding phase command signals used to shift, hold and erase trapped charge are well understood from the teachings in the prior art.

DETAILED DESCRIPTION

The present invention teaches a utilitarian electronic circuit configuration particularly suited for energizing the high voltage electrodes in a plasma charge transfer type display system, when using hybrid or monolithically fabricated devices having moderate voltage capability. More particularly, the invention teaches the construction and interconnection of driver circuit groups, using a multiplicity of substantially identical electronic devices, operated from a dual polarity voltage source, to load, shift, hold and erase data within a shift type plasma display. The ensuing disclosure presumes that the reader is versed in the art of shift type plasma display systems as generally taught in U.S. Pat. Nos. 3,781,600 and 4,051,409, incorporated herein by reference. These patents are particularly useful, since they provide the fundamental operating characteristics of the display panel in such a way that the distinguishing features of the present invention can be discerned from the polarity and timing of electrical signals on a group of voltage versus time plots.

Figure 1:
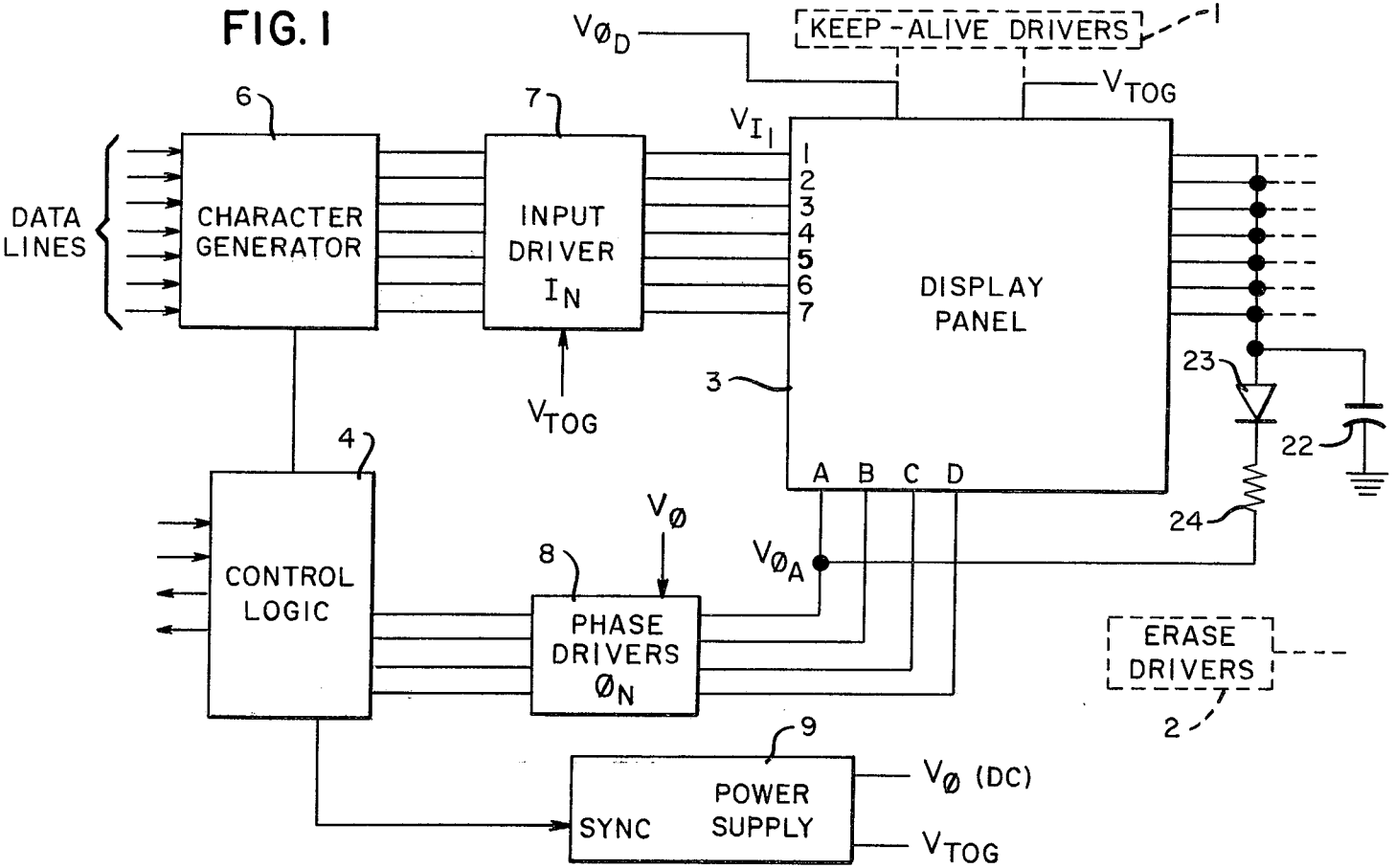
FIG. 1 contains a block diagram schematically showing an embodying plasma charge transfer type display system.

In an attempt to maintain continuity with the cited art, the schematic depicted in FIG. 1 utilizes a similar format. Furthermore, within the body of this specification, like elements are designated with identical reference numerals.

Though the art is replete with teachings of display systems and the conceptual aspects of their control, the practical problem of actually implementing the display operations is far from rudimentary when the multitude of conflicting objectives and constraints are recognized. This is particularly true in cases of the type at hand, where the display panel contains a great multitude of data lines, while the cost and size of the driving elements is highly constrained. Undoubtedly one is aware that microcomputers are readily available to implement the control logic. Miniaturization of the driving elements is, however, limited by the voltage amplitudes required at the electrodes of the display to properly load, shift, hold and erase information within the display panel. As is recognized from the prior art noted above, transient voltages in excess of 300 volts, as well as sustained levels of a nominal 200 volts, are required to operate such plasma charge transfer systems. The normal inclination to use hybrid or monolithically fabricated driver devices, in an attempt to reduce electronic component size and power consumption, is not reconcilable with the voltage needs of the panel. Moderately priced and readily available devices of this type are not normally rated at voltages much beyond 140 volts. Therefore, those practicing in the art generally utilize high voltage discrete components operated in conjunction with one or more single polarity power supplies. In terms of modern microelectronics, the physical size of discrete device driver circuits is tremendous, and grows in proportion to the number of data lines in the display. Though the embodying display panel depicts only seven data lines, a representative commercial display would more likely contain in excess of thirty lines. The disadvantage of using discrete driver elements is self-evident.

Attention is now directed to FIG. 1 of the drawings, where one embodiment of the invention is schematically depicted in block diagram form. For purposes of contrast, deleted keep-alive driver circuit block 1 and erase driver circuit block 2, typifying the prior art, are shown in location by way of dashed lines. Display panel 3, control logic block 4 and character generator block 6 are substantially identical to the counterparts described in the latter of the above-noted U.S. patents. Any unique features attributable to these three blocks will become self-evident from the description of the invention embodiment. Consequently, the focus of attention will be directed to input driver block 7, phase driver block 8, power supply block 9 and the unique interconnection with display panel 3 to obtain the voltage reduction objectives sought.

Figure 2:
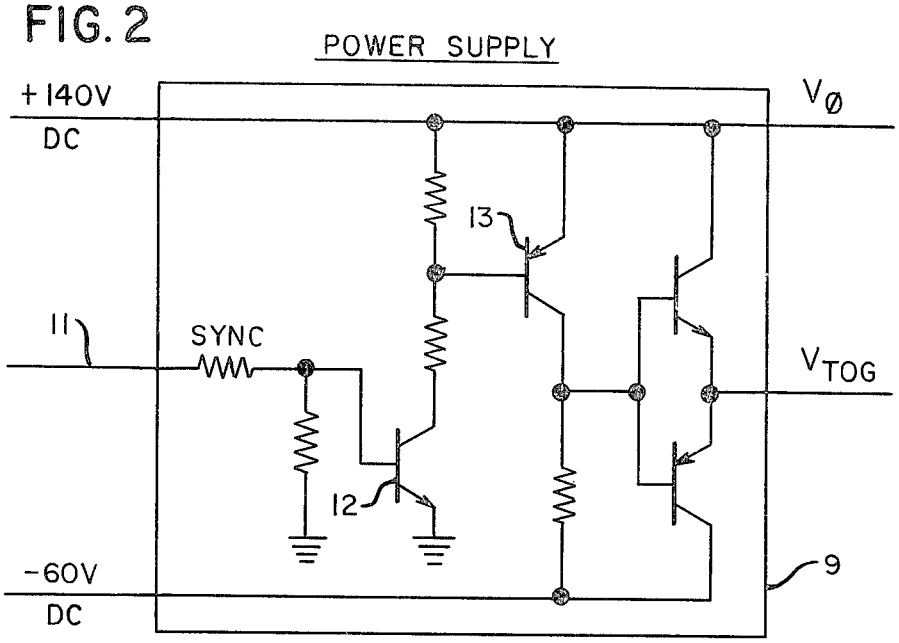
FIG. 2 is a schematic diagram of a switching power supply.

First consider the structure of power supply block 9, as it is depicted in FIG. 2 of the drawings. Electrical power is provided to the block from a conventional voltage source having both +140 volts D.C. and −60 volts D.C. The supply output line designated $V_\phi$ is merely a continuation of the former D.C. voltage. The output voltage designated $V_{TOG}$ is otherwise. $V_{TOG}$, generally referred to hereinafter as the toggle voltage, takes the form of an unbalanced square wave switched abruptly between −60 volts and +140 volts at a rate defined by the synchronization command signal entering at line 11. The command signal supplied to line 11 is a periodic, square, positive-going voltage pulse generated in control logic block 4. Since the operation of the switching circuit in FIG. 2 is as a whole rudimentary, an intimate description of each element's operation is considered superfluous. It suffices to note that that circuit is fundamentally non-inverting and operates such that the absence of a positive voltage command signal on line 11 drives $V_{TOG}$ to the −60 volt extreme of its excursion, while the presence of the signal causes saturation of transistors 12 and 13, and accordingly, an output of +140 volts. The cyclic rate of the command signal, and $V_{TOG}$ derived therefrom, defines the maximum rate at which data, in the form of trapped wall charge, can be entered into the display panel.

Figure 3:
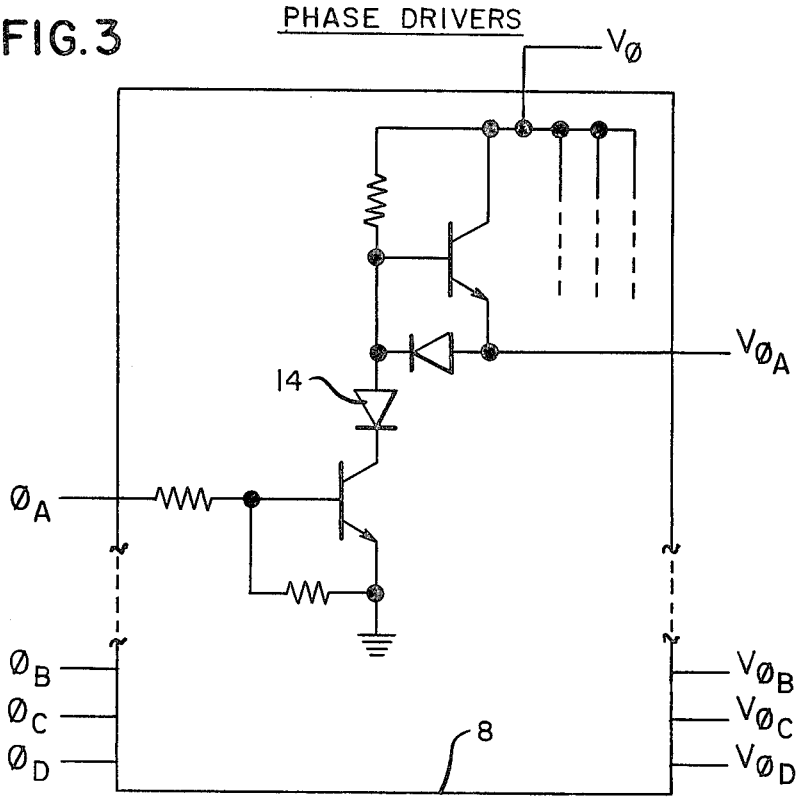
FIG. 3 contains a schematic diagram of the phase driver circuits.
Figure 4:
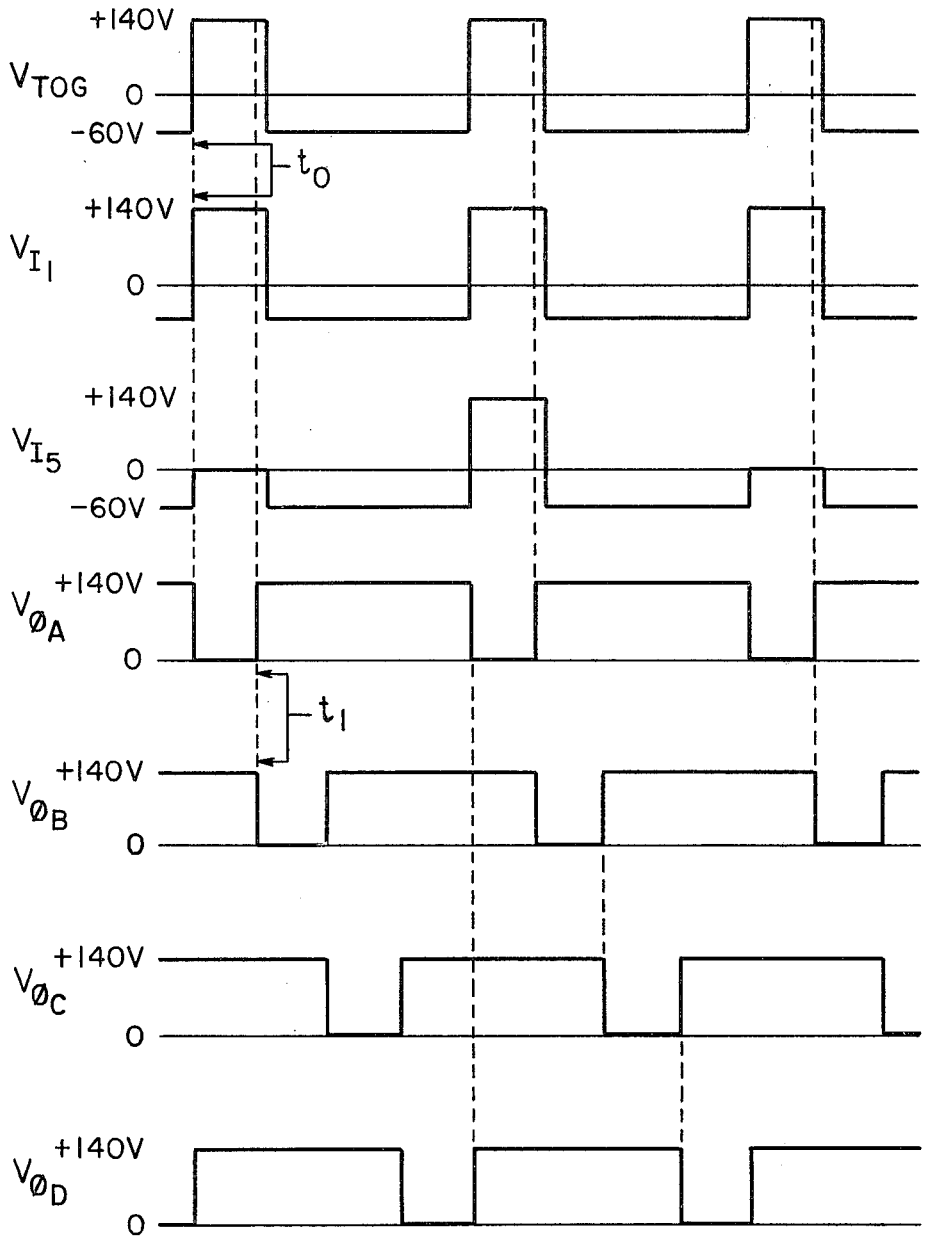
FIG. 4 contains a group of seven voltage versus time plots depicting the waveforms at various electrical nodes within the display system.

Attention now turns to phase driver block 8, shown in FIG. 3 to contain within a single structural unit four identical, hybrid phase driver circuits. At this point it is also useful to note that the time plots of the different circuit voltages are depicted in FIG. 4. For purposes of distinguishing the various phase driver block outputs voltages the waveforms are designated with subscripts $\phi_A$ to $\phi_D$. One input to phase driver block 8 is the +140 volt D.C. voltage $V_\phi$; the others are comprised of a group of command signals $\phi_A$ to $\phi_D$ originating in control logic block 4. The number and relationship of the input phases are described adequately in the above-noted prior art. Therefore, it suffices to note that the embodying command and phase driver output signals are characterized by step changes in voltage which follow the ordered, repetitive sequence shown in FIG. 4. Though time coincident, the amplitudes of command signals $\phi_A$ to $\phi_D$ are the inverse of the waveforms depicted in FIG. 4, namely zero when $V_{\phi A}$ to $V_{100\,D}$ are at +140 volts and some moderate positive magnitude during the time when the phase driver output voltages are at the zero level. Recalling that the contemplated device forming control logic block 4 is a microprocessor, the voltage peaks of command signals $\phi_A$ to $\phi_D$ will fall within the range of 5 to 15 volts.

The electronic elements forming the internal circuitry of phase driver block 8 also appear in FIG. 3. An example of a commercially available device internally configured in the manner shown is the hybrid unit designated by part number KH6844 and manufactured by Toko, Incorporated. Recognizing that the operation of the device is within the understanding of those working in the art, only the idiosyncrasies of this circuit, as they uniquely suit the needs of the display panel system, will be accentuated hereinafter. For purposes of driving the embodying display panel phase lines, it need only be noted that diode 14 in the circuit is unnecessary, in view of the positive polarity of $V_\phi$ and the low relative magnitudes of command signals $\phi_A$ to $\phi_D$ in comparison to $V_\phi$.

Figure 5:
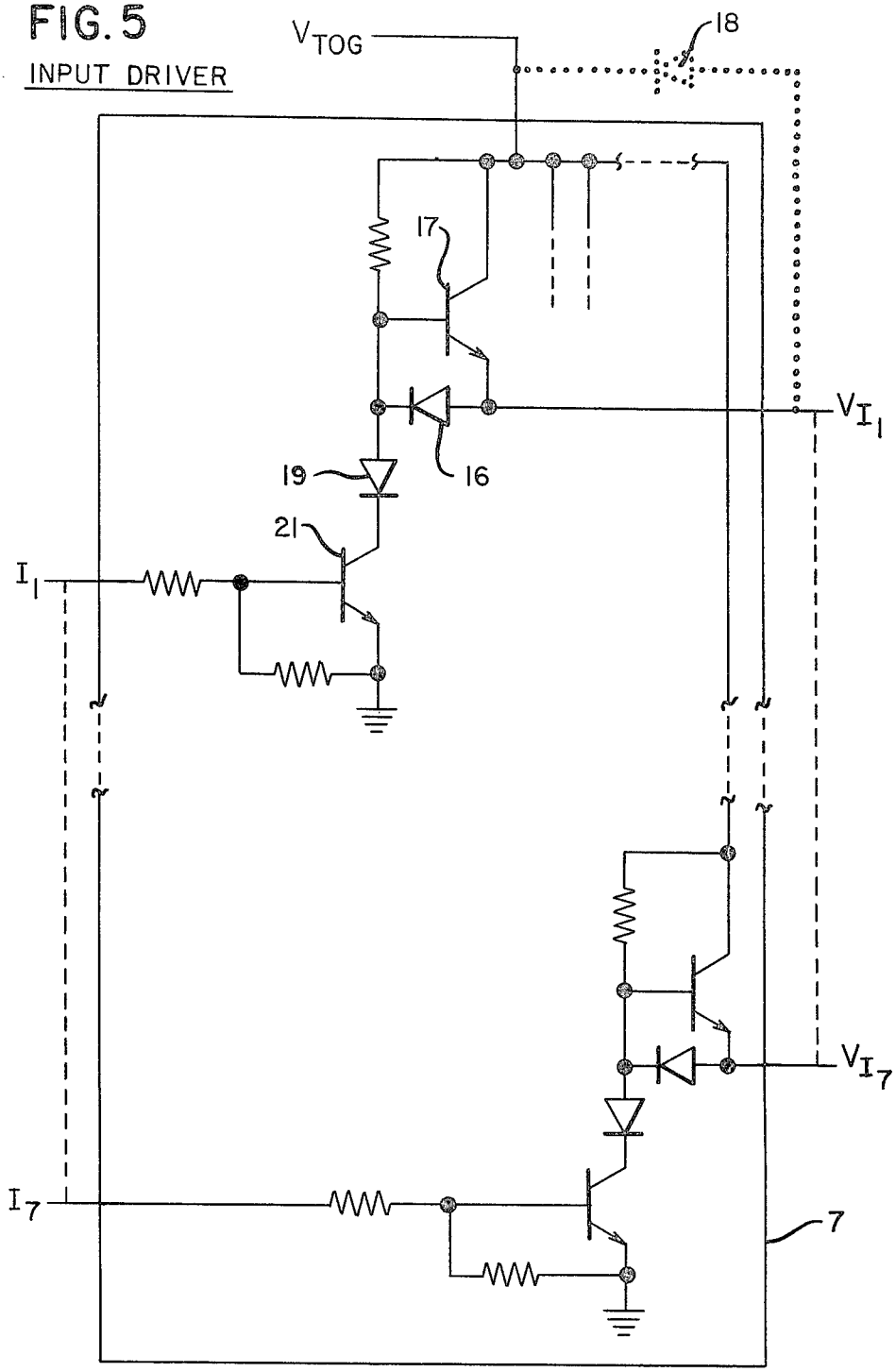
FIG. 5 shows the schematic diagram of an embodying input driver circuit.

Attention is now directed to input driver block 7, schematically depicted in FIG. 5 of the drawings. As clearly appears, the internal structure of each driver circuit is identical to that shown in the above-described phase driver block. However, the number of individual input driver circuits is significantly greater, in that an individual driver circuit is needed for each data line in the display panel. The embodiment shows seven such lines. The command signals entering block 7, $I_1$ to $I_7$, eminate from control logic block 4, and are characterized as being either zero or low positive amplitude voltage pulses. Distinguishing from the phase driver block, the power supplied to input driver block 7, $V_{TOG}$, is not a fixed D.C. level, but rather, comprises a square wave periodically switching between −60 volts and +140 volts. A time plot showing the waveform appears in FIG. 4.

An analysis of the toggle voltage waveform and the electronic elements in each circuit driving an input line of the display panel reveals that the signals $V_{I1}$ to $V_{I7}$ are complex partial modulations of $V_{TOG}$ with command signals $I_1$ to $I_7$, respectively. The actual waveforms on exemplary input lines will be described in detail during the ensuing analysis of the system operation. Presently, for purposes of understanding the circuit in FIG. 5, it suffices to note that diode 16 and the PN junction between the base and collector leads of transistor 17 are forward biased during the period when $V_{TOG}$ is negative in polarity. Functionally, this is equivalent to the phantom diode shown at reference numeral 18, providing a direct path for negative polarity voltage. In contrast to the phase driver circuit described earlier, diode 19 in the input driver circuit is a necessary element to prevent the effects of a negative $V_{TOG}$ from propagation through the PN junction of transistor 21 to molest the command signals $I_1$ to $I_7$.

With an understanding of the functional blocks and their constituent circuits at hand, the succeeding inquiry will dwell on their cooperative interaction to properly actuate the display panel. The beneficial practical considerations noted previously, namely overcoming the inherent voltage limitations of hybrid and monolithic drivers, will become apparent. Likewise, the innate ability to delete ancillary circuits, such as keep-alive drivers 1 and erase drivers 2, will become evident.

Consider now the multitude of voltage waveforms as they appear in FIG. 4, selectively representing the voltage versus time characteristics at various locations in the embodying display system of FIG. 1. As a prelude to the operational description, however, note that the plots of exemplary input driver voltages, $V_{I1}$ and $V_{I5}$, transition between their positive and negative extremes no earlier than, and preferably after, phase voltage $V_{\phi A}$ reaches its positive extreme and $V_{\phi B}$ reaches its negative extreme. The dashed projection line in the plots shows the slightly delayed transition embodied. The purpose for this delay is to ensure that trapped wall charge adjacent each $\phi_A$ electrode in the display panel consistently transfers to a point adjacent $\phi_B$ electrode, rather than return to the input electrode by way of a backfire. The deleterious effect known as backfire is described in the former of the previously noted U.S. patents.

The first plot shown in FIG. 4 represents the toggle voltage, $V_{TOG}$, spanning a range of −60 volts to +140 volts with respect to system ground. Immediately below are plots of two, representative input driver voltages, $V_{I1}$ and $V_{I5}$. The remaining four waveforms plotted in the Figure are the phase driver voltages. Since the important aspects of the invention focus on the loading segment of the panel operating sequence, the plots depict only that segment. The extension of these teachings to the shift, hold and erase segments is thought to be rudimentary in view of the cited prior art, and therefore, omitted from the plots.

Commence the analysis of the display system's operation by noting the amplitudes of exemplary input driver voltages $V_{I1}$ and $V_{I5}$ at a point in time immediately preceding time $t_0$, the initial rise in $V_{TOG}$ to its +140 volt level. With the toggle voltage at −60 volts, and the previously described path through diode 16 and transistor 17 of the input driver circuit, shown in FIG. 5, the −60 volts appears on line 1 and electrode 1 of the display panel. The state of input electrode 5 is the same. Note also, that during this same period of time the voltage $V_{\phi A}$ applied to phase line A and electrode A of the display panel is at +140 volts.

At the next point in time of concern, $t_0$, the toggle voltage switches abruptly from −60 volts to +140 volts. However, output voltages $V_{I1}$ and $V_{I5}$, from the first and fifth input driver circuits, do not follow the toggle voltage unless the appropriate zero voltage command signals, $I_1$ and $I_5$, are present. In the waveform depicted, command signal $I_1$ is at the zero volt level while signal $I_5$ is at a nominal positive voltage. For contrast compare the effects at each of the input lines.

First consider the characteristics and effects of the voltages applied to input electrode 1 and adjacent phase electrode A. At time $t_0$, the synchronization of command signals from control logic 4 drives the phase voltage $V_{\phi A}$ from its previous +140 volt level to a substantially zero level, as it drives the input voltage $V_I$ from its −60 volt level to a +140 volt level. The cumulative effect, however, is significantly greater since the cell gas experiences a relative transition of 340 volts between the input and phase electrodes when compared to the state prior to time $t_0$. This transient voltage variation is sufficient to cause cell gas ionization and a trapped charge formation adjacent phase A electrode.

In contrast consider the time $t_0$ activity at input electrode 5. As shown in the plot, though $V_{\phi A}$ undergoes an abrupt switch from +140 volts to a zero level, input voltage $V_{I5}$ is limited to a zero level rise by the control logic command signal to the input driver circuit. Consequently, the cell gas only experiences a 200 volt transition of relative voltage, an amplitude inadequate to ionize the cell gases and cause trapped charge adjacent phase A electrode in line 5.

The next point in time of interest is $t_1$. At time $t_1$ command signals are directed to phase driver circuits A and B, increasing voltage $V_{\phi A}$ and decreasing voltage $V_{\phi B}$. With an understanding of the prior art at hand, one readily recognizes that the positive charge trapped adjacent phase electrode A of line 1 is transferred to phase electrode B in line 1. At phase electrode A of line 5, however, there is no positive wall charge, consequently no transfer to phase electrode B in line 5. Viewing the whole of the input waveforms depicted in FIG. 4, the voltages show that line 1 is loaded with data represented by three successive bits of charge, while line 5 contains a charge bit between two non-charged bits. The 140 volt relative transition attendant the phase A voltage rise at $t_1$ is less than the magnitude necessary to ionize the gas between input electrode 1 and phase electrode A.

At some point in time soon after $t_1$, the toggle voltage is commanded by logic block 4 to revert to its −60 volt level. Accordingly, input driver voltages $V_{I1}$ and $V_{I5}$ follow to that level. The short delay between time $t_1$ and the transition of the toggle voltage is, as was noted hereinbefore, inserted to ensure that charge trapped adjacent phase electrode A moves to phase electrode B rather than undergo a backfire to input electrode 1. Furthermore, the delayed transition of the toggle voltage significantly reduces the magnitude of the relative voltage change experienced by the cell, substantially suppressing the gas ionization associated with the input voltage transition to its −60 volt level.

A salient feature of the invention can be discerned by noting the magnitudes of voltage impressed across the various devices in the input and phase driver blocks. Notwithstanding the 340 volt transient and 200 volt steady state amplitudes impressed across cell electrodes, the devices used in the circuits require a nominal operating voltage of only 140 volts. The desirability is self-evident, since this voltage is within the limits of commercially available hybrid and monolithic devices.

Another beneficial aspect of the invention resides in the polarity of the voltages as they are developed in FIG. 4. Note that $V_{\phi A}$ is negative in relation to $V_{I1}$, immediately after time $t_0$, the gas ionization time. This polarity coincides with the objective that positively charge ions, and not electrons, be trapped adjacent phase A electrode, to facilitate subsequent shifting into the display panel.

The invention depicted in FIG. 1 provides a number of ancillary benefits. As shown, the conventional keep-alive driver circuit, 1, is supplanted by connecting one terminal to the toggle voltage, $V_{TOG}$, and the remaining terminal to the phase driver voltage $V_{\phi D}$. An analysis of the corresponding waveforms in FIG. 4 shows the presence of a periodic 200 volt transition, adequate to repeatedly ionize the gas between the keep-alive driver electrodes within the display panel. Connection to phase driver line D represents merely one example of implementing the keep-alive function. Others of the phase driver lines are also viable alternatives, as long as the voltage in that phase continues to alternate during display panel operation. An example of an unacceptable keep-alive connection is a phase which is not toggled during a hold sequence in the display.

Note also from FIG. 1 that the previously necessary erase driver block, 2, is readily replaced with a soft erase circuit connected to phase driver line A. As shown, the display erase electrodes are connected to a common terminal for collecting charge onto capacitor 22 and slowly dissipating that charge through directional diode 23 and resistor 24.

The invention as described herein presupposes the need for a nominal 340 volt transition between display electrodes to obtain consistent ionization of cell gases and reliable wall charge formation. Likewise, the 140 volt phase driver amplitude corresponds to that which is reasonably necessary to reliably transfer charge during display panel operation, tempered by the voltage capabilities of commercial hybrid and monolithic devices. Common use of a single +140 volt supply in this embodiment thus dictates the −60 volt amplitude of the negative power supply. The invention as a whole, however, fully contemplates relative variations in the voltage amplitudes and polarity distributions as may be necessary to suit the particular needs and capabilities of the plasma charge transfer display panel actually utilized.

I claim:

1. A driver circuit for creating and sequentially shifting trapped wall charge between cells in a plasma charge transfer display panel, comprising:

means for providing a first voltage of a first polarity and a second voltage of a second polarity;

a multiplicity of input driver circuits, electrically connected between said means for providing a first and second voltage and a group of input driver lines in said display panel, each of said input driver circuits being continuously conductive to first polarity voltage and selectively conductive to second polarity voltage;

means for providing a third voltage of said second polarity;

a multiplicity of phase driver circuits, each electrically connected between said means for providing a third voltage and a group of phase driver lines in said display panel, each of said circuits being selectively conductive; and control means, operatively connected to said input and phase driver circuits, for providing said first voltage at selected input driver lines at the time the first of said phase driver lines is provided with said third voltage, switching the voltage on the first of said phase driver lines to substantially zero coincident with switching the voltage on said selected input driver lines to the second voltage, and switching the voltage on the first of said phase driver lines from the substantially zero to said third voltage before said selected input driver lines are switched from said second voltage.

2. The device recited in claim 1, wherein said means for providing a first and second voltage comprises a voltage source sequentially switching between said first and second voltages.

3. The device recited in claim 2, wherein:

the amplitude of said third voltage is sufficient to cause transfer of trapped charge between successive cells in said display panel; and the sum of the absolute values for said first, second and third voltages exceeds the ionization voltage of the gas in said display panel cells.

4. The device recited in claim 3, wherein the absolute values of said first, second and third voltages are nominally less than the 150 volts.

5. An improved plasma charge transfer type display system having a display panel with a multiplicity of input and phase driver lines, selectively connected to electrodes in gas filled cells, and a control logic specifying the timing sequence, wherein the improvement comprises:

means for providing a first voltage, having a first polarity and an amplitude substantially equal to the voltage required to transfer trapped charge between electrodes within said display panel;

means for providing a second voltage, having a second polarity opposite that of said first polarity;

means for sequentially switching an output voltage between said first and said second voltages in response to synchronization command signals from said control logic;

means, operatively connected between said means for switching and said display panel input lines, for selectively providing the switched output voltage to said display panel input lines whenever the switched output voltage is of the second voltage or is of the first voltage and coincides in time with a charge formation command signal from said control logic, and providing substantially zero voltage to said display panel input lines whenever the switched output voltage is of the first voltage and said charge formation command signal is absent;

means, operatively connected between said first voltage and said display panel phase driver lines, for providing either said first voltage or substantially zero voltage to said phase driver lines in accordance with phase command signals from said control logic; and means for generating synchronization command signals, charge formation command signals and phase command signals in said control logic, operable so that said means for sequentially switching is commanded to switch the output voltage from said second voltage to said first voltages in time coincidence with phase command signals switching the voltage on said driver lines from said first voltage to a level of substantially zero voltage, and further where said means for sequentially switching is commanded to remain at said first voltage until a point in time after said phase command signals switch the voltage on said phase driver lines from substantially zero to said first voltage.

6. The improvement recited in claim 5, wherein said means for selectively providing the switched output voltage to said display panel input lines comprises a multiplicity of substantially identical electronic circuits, in numerical correspondence to said display input lines, each containing a selectively controllable conductive path for first polarity current flow between said means for sequentially switching and said display panel input lines, and a continuously conductive path for second polarity current flow between said display panel input lines and said means for sequentially switching.

7. The improvement recited in claim 6, wherein said first voltage is substantially equal to positive 140 volts, said second voltage is substantially equal to negative 60 volts, and said means for selectively providing the switched output voltage to said input lines comprise hybrid or monolithically fabricated inverting, transistorized driver circuits having negative supply voltage protection and a negative supply voltage current path between said display panel input lines and said means for switching.

8. The improvements recited in claims 5, 6 or 7, wherein said display panel further contains a pair of keep-alive electrodes having first and second energizing terminals, and an erase driver terminal for each of said input driver lines, wherein said improvement further comprises a first electrical connection between said first keep-alive terminal and said means for sequentially switching, a second electrical connection between said second keep-alive terminal and a phase driver line, and a third electrical connection joining commonly connected erase driver terminals to a phase driver line through a soft erase circuit.

* * * * *